US008186513B2

(12) United States Patent
St. John et al.

(10) Patent No.: US 8,186,513 B2
(45) Date of Patent: May 29, 2012

(54) BOX CONSTRUCTION

(75) Inventors: John St. John, Lake Arrowhead, CA (US); Tony D. Steele, Hemet, CA (US)

(73) Assignee: Systems Technology, Inc., San Bernardino, CA (US)

( * ) Notice: Subject to any disclaimer, the term of this patent is extended or adjusted under 35 U.S.C. 154(b) by 71 days.

(21) Appl. No.: 12/851,775

(22) Filed: Aug. 6, 2010

(65) Prior Publication Data

US 2012/0031958 A1 Feb. 9, 2012

(51) Int. Cl.
*B65D 73/00* (2006.01)

(52) U.S. Cl. ..... 206/495; 229/122.27; 229/122.34

(58) Field of Classification Search ..... 206/495, 206/497, 477, 483; 229/122.27, 122.34, 229/174, 178, 122.32; 53/457, 458, 467
See application file for complete search history.

(56) References Cited

U.S. PATENT DOCUMENTS 2,695,128 A * 11/1954 Rendall ..... 229/117.13
2,698,124 A * 12/1954 Hines ..... 229/122
3,342,399 A * 9/1967 Reynolds ..... 229/122.32
3,543,995 A * 12/1970 Wilson ..... 229/102
3,666,166 A 5/1972 Freakes ..... 206/424
3,684,158 A * 8/1972 Harris ..... 229/221
3,952,672 A 4/1976 Gordon et al. ..... 108/51.3
4,322,028 A 3/1982 Kawahara ..... 229/103.2
4,356,952 A * 11/1982 Rekow ..... 206/511
4,883,221 A * 11/1989 Brundage ..... 229/143
5,522,504 A 6/1996 Levi ..... 206/424
5,649,663 A * 7/1997 Pestow, Jr. ..... 229/190
5,678,695 A 10/1997 Ridgeway et al. ..... 206/583
5,833,131 A 11/1998 Levi ..... 229/103.2
6,010,006 A 1/2000 Ridgeway et al. ..... 206/583
7,044,359 B1 * 5/2006 Cohen ..... 229/122.34
7,080,772 B2 * 7/2006 Lebras ..... 229/122.27

* cited by examiner

*Primary Examiner* — David Fidei
(74) *Attorney, Agent, or Firm* — Roberts & Roberts, LLP

(57) ABSTRACT

Box constructions suitable for packaging, storing and transporting small objects including flat rectangular objects of any size such as books, CD's, DVD's, and the like. The box construction has an outer member which surrounds an inner member. An object is packaged by attaching an object onto a surface of the inner member; positioning the inner member on the outer member; folding panel of the outer member around the object on the inner member; and attaching the panels of the outer member thus enclosing the object within the box construction.

14 Claims, 4 Drawing Sheets

BOX CONSTRUCTION

BACKGROUND OF THE INVENTION

1. Field of the Invention

The present invention relates to box constructions. More particularly, the invention pertains to box constructions suitable for high volume cost efficient packaging and order fulfillment for objects of variable size such as books, CD's, DVD's, and other objects that fall within that general size range.

2. Description of the Related Art

It is well known in the art to produce shipping and storage boxes in a wide variety of sizes and shapes. One of the most common is a hollow, six-sided cubic or three dimensional rectangular structure having corrugated cardboard side walls as well as top and bottom closures. It is also well known in the art to provide storage and shipping boxes for printed materials and other media such as books, CD's, DVD's and other objects that fit within the same volumetric dimensions. Such objects might include a wide variety of consumer retail and industrial products. It has been a disadvantage in the packaging and fulfillment industry to provide cost effective means for wrapping objects of varying sizes. Typically, an individual box size is needed for the dimensions of a given object size. Clearly, an object which is too large for its packaging either will not fit or will deform the box. Objects which are smaller than the box dimensions can be accommodated by either using padding or other dunnage or else they will be loose within the box during shipping and hence subject to damage. These constraints require that the fulfillment or packaging company keep a large inventory of different box sizes for shipping objects of varying sizes. With the advent of more on-line direct-to-consumer retail selling, the packaging and fulfillment of such on-line direct-to-consumer orders requires a more efficient process. The present invention provides a two-piece carton which can effectively serve a large range of randomly sized objects. The invention provides a carton for packaging objects which allows for variations in the size of the packaged product and yet provides a controlled retention of the product without changing the carton size, to minimize the chance for damage. Furthermore, the invention provides a design that can readily be automated for high volume lower unit cost fulfillment operations.

Most typical method of packaging and fulfillment utilize what is known in the industry as a knock down regular slotted case, or RSC, which requires the RSC to be erected into its shape, bottom sealed or taped, loaded with the objects, the dunnage must be added, and then the top must be closed and sealed. This method requires a great deal of labor and the packaging material costs can be relatively high. Another typical method is to use a die cut carton blank of a T-shaped design sized to fit the objects. These carton blanks, regardless of their many design variations, require special cutting dies for their manufacture. This is a considerable cost factor, especially when short production runs of varying carton sizes are required. This results in a need for a multitude of dies and substantial inventories of different carton sizes. Furthermore, many of the existing package designs do not lend themselves to high speed machine automation.

U.S. Pat. No. 4,322,028 shows a knock-down type mailing parcel case which comprises a rectangular cardboard main body having the opposite inwardly folded side edges and a pair of rectangular cardboard flaps extending perpendicular to the longitudinal axis of the main body and secured at one end to the folded side edges. U.S. Pat. No. 3,666,166 shows a wrapping set for packaging books or the like, comprising inner and outer panels, each panel being provided with inner and outer scored lines defining central, side and flap portions when said panels are folded at the lines. The inner panel is folded about the package contents, and the outer panel is then folded about the inner panel in a direction transverse to the following direction of the inner panel, and is adhered to the inner panel. U.S. Pat. No. 3,952,672 shows a pallet including an outer structure folded about an inner structure. U.S. Pat. No. 5,833,131 shows corrugated box constructions suitable for packaging, storing and transporting flat rectangular objects such as books. The box has an upper member and a lower member, each with a generally rectangular central panel, a pair of side panels, one of which is hingedly joined to each of the opposite ends of the central panel. Attached to each side panel of the upper member is an underlying panel and attached each side panel of the lower member is an overhanging panel. The side panels of the lower member fold upward, then the overhanging panel folds parallel to the central panel. The side panels of the upper member fold perpendicularly downward, then underlying panel folds under the central panel of the lower member. The upper member is attached to the lower member with an optional adhesive or strap. The construction allows for packaging products of various sizes.

It has been found that the two-piece carton design of this invention reduces the need for a large carton blank inventory since it allows for the use of one set of blanks for cartoning a multitude of product sizes, provides secure packaging for shipment without product damage and without the need for extra protective dunnage and lends itself to high speed automation for the increased volumes that today's direct-to-consumer fulfillment industry requires.

SUMMARY OF THE INVENTION

The invention provides a box construction comprising an outer member which comprises:

(i) a rectangular base panel having a length and a width defining two oppositely positioned longitudinal ends and two oppositely positioned transverse ends perpendicular to the longitudinal ends; an inner side panel, the inner side panel being hingedly joined to one of said transverse ends of the rectangular base panel at a fold line, which fold line extends between the inner side panel and the rectangular base panel; a pair of inner end panels, one of said inner end panels being hingedly joined to each of the longitudinal ends of the rectangular base panel at a first end panel fold line which extends between said base panel and its respective first end panel; each of the inner end panels having a corner panel extending outwardly from a side of one of said inner end panels and being attached to its respective first end panel at a corner panel fold line which corner panel fold line is adjacent to and positioned perpendicular to its respective first end panel fold line;

ii) an intermediate side panel having a length and a width defining two oppositely positioned longitudinal ends and two oppositely positioned transverse ends perpendicular to the longitudinal ends, the intermediate side panel being hingedly joined to an opposite transverse end of the rectangular base panel at an intermediate side panel fold line, which intermediate side panel fold line extends between said intermediate side panel and the rectangular base panel; a pair of dust panels, one dust panel attached at each of the oppositely positioned transverse ends of the intermediate side panel at a fold line; and iii) a rectangular top panel having a length and a width defining two oppositely positioned longitudinal ends and two oppositely positioned transverse ends perpendicular to the longitudinal ends; the rectangular top panel being hingedly joined along one transverse end of the rectangular top panel to the intermediate side panel at a fold line opposite to the intermediate side panel fold line; a pair of outer end panels, one of said outer end panels being hingedly joined to each of the longitudinal ends of the rectangular top panel at a outer end panel fold line which extends a distance between said rectangular top panel and its respective outer end panel; an outer side panel, the outer side panel being hingedly joined to the opposite transverse end of the rectangular top panel at a fold line which fold line extends a distance between said outer side panel and the rectangular top panel;

iv) a plurality of cavities, at least one cavity being positioned through the inner side panel at a position adjacent to the fold line and another cavity being positioned through the intermediate side panel at a position adjacent to the intermediate side panel fold line; or at least one cavity being positioned through each of the inner end panels at a position adjacent to its respective fold line between the top panel and the respective inner end panel.

The invention also provides a method for enclosing an object which comprises the steps of:

I) providing a box construction which comprises an outer member and an inner member, A) the outer member comprises:

(i) a rectangular base panel having a length and a width defining two oppositely positioned longitudinal ends and two oppositely positioned transverse ends perpendicular to the longitudinal ends; an inner side panel, the inner side panel being hingedly joined to one of said transverse ends of the rectangular base panel at a fold line, which fold line extends between the inner side panel and the rectangular base panel; a pair of inner end panels, one of said inner end panels being hingedly joined to each of the longitudinal ends of the rectangular base panel at a first end panel fold line which extends between said base panel and its respective first end panel; each of the inner end panels having a corner panel extending outwardly from a side of one of said inner end panels and being attached to its respective inner end panel at a corner panel fold line which corner panel fold line is adjacent to and positioned perpendicular to its respective inner end panel fold line;

ii) an intermediate side panel having a length and a width defining two oppositely positioned longitudinal ends and two oppositely positioned transverse ends perpendicular to the longitudinal ends, the intermediate side panel being hingedly joined to an opposite transverse end of the rectangular base panel at an intermediate side panel fold line, which intermediate side panel fold line extends between said intermediate side panel and the rectangular base panel; a pair of dust panels, one dust panel attached at each of the oppositely positioned transverse ends of the intermediate side panel at a fold line; and iii) a rectangular top panel having a length and a width defining two oppositely positioned longitudinal ends and two oppositely positioned transverse ends perpendicular to the longitudinal ends; the rectangular top panel being hingedly joined along one transverse end of the rectangular top panel to the intermediate side panel at a fold line opposite to the intermediate side panel fold line; a pair of outer end panels, one of said outer end panels being hingedly joined to each of the longitudinal ends of the rectangular top panel at an outer end panel fold line which extends a distance between said rectangular top panel and its respective outer end panel; an outer side panel, the outer side panel being hingedly joined to the opposite transverse end of the rectangular top panel at a fold line which fold line extends a distance between said outer side panel and the rectangular top panel;

iv) a plurality of cavities, at least one cavity being positioned through the inner side panel at a position adjacent to the fold line and another cavity being positioned through the intermediate side panel at a position adjacent to the intermediate side panel fold line; or at least one cavity being positioned through each of the inner end panels at a position adjacent to its respective fold line between the top panel and the respective inner end panel;

B) an inner member which comprises a planar, rectangular panel having a length and a width defining two oppositely positioned longitudinal ends and two oppositely positioned transverse ends; a plurality of stubs extending outwardly from oppositely positioned ends of the planar, rectangular panel and said stubs being within the plane of the planar, rectangular panel; each of the stubs of the inner member being positioned within one of the cavities of the outer member; and conducting II), III, IV), and V) in any order:

II) affixing an object onto a surface of the inner member;

III) positioning an opposite surface of the inner member on the rectangular base panel such that each of the stubs of the inner member is positioned within one of the cavities of the outer member;

IV) folding the inner side panel, the inner end panels, the corner panels; the intermediate side panel, the dust panels, the rectangular top panel, the outer end panels, and outer side panel around the object on the inner member; and V) attaching at least some of the inner side panels, the inner end panels, the corner panels, the outer end panels, and outer side panel to its respective adjacent panel thus enclosing the object within the box construction.

In one embodiment the steps are conducted in the order I, and then II, and then III, and then IV, and then V.

DESCRIPTION OF THE INVENTION

Figure 1:
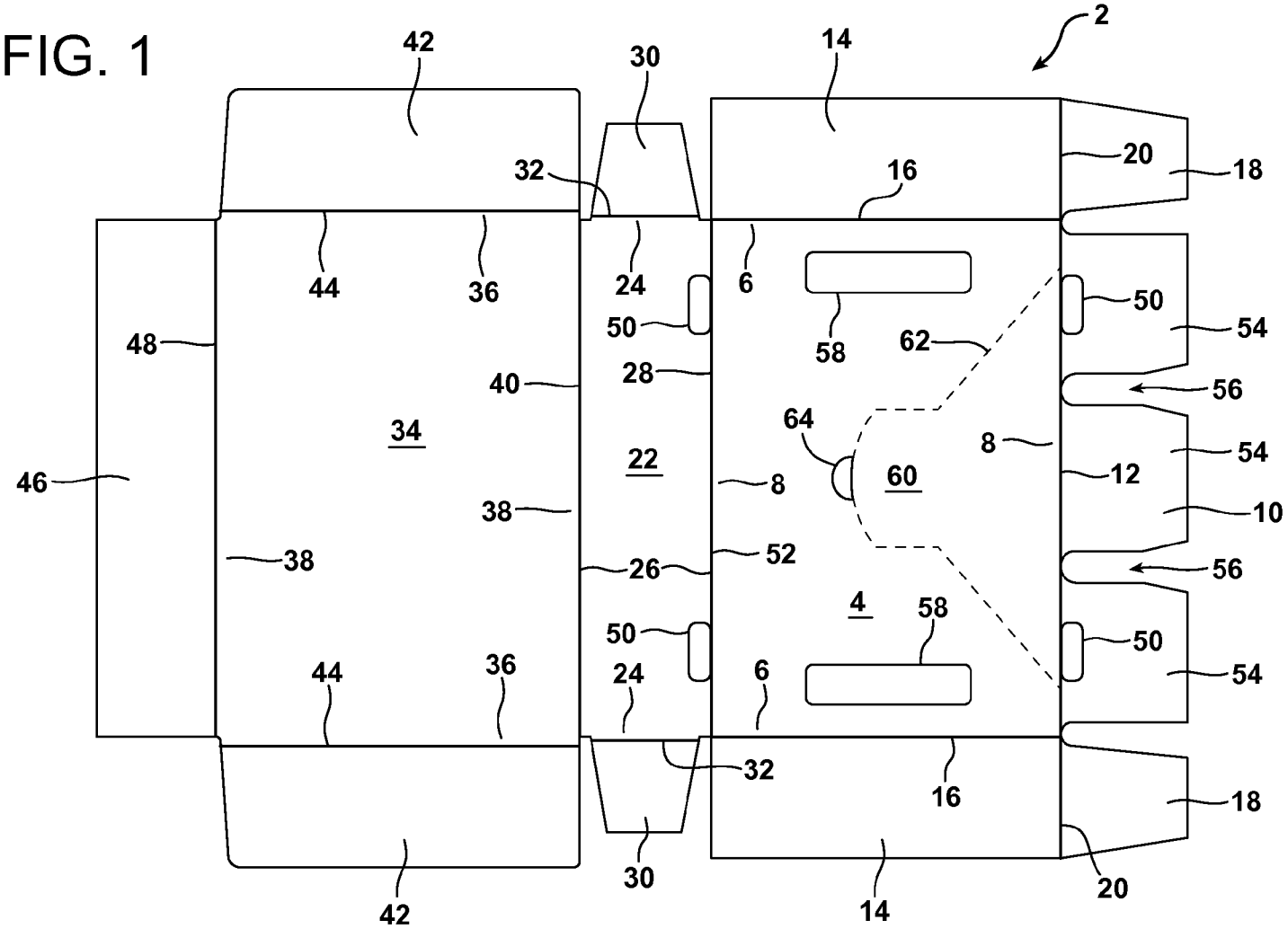
FIG. 1 illustrates an outer member portion of the box construction of the present invention.

Referring to FIG. 1, there is shown an outer member 2 portion of the box construction of the present invention. The outer member 2 has a rectangular base panel 4 having a length and a width defining two oppositely positioned longitudinal ends 6 and two oppositely positioned transverse ends 8 perpendicular to the longitudinal ends 6; an inner side panel, the inner side panel 10 being hingedly joined to one of said transverse ends 8 of the rectangular base panel 4 at an inner side panel fold line 12. The inner side panel fold line 12 extends between the inner side panel 10 and the rectangular base panel 4. It has a pair of inner end panels 14, wherein one of said inner end panels 14 is hingedly joined to each of the longitudinal ends 6 of the rectangular base panel 4 at an inner end panel fold line 16 which extends between the base panel 4 and its respective inner end panel 14. Each of the inner end panels 14 has a corner panel 18 extending outwardly from a side of one of said inner end panels 14. The corner panels 18 are attached to its respective inner end panel 14 at a corner panel fold line 20. Each corner panel fold line 20 is adjacent to and positioned perpendicular to its respective inner end panel fold line16.

Outer member 2 has an intermediate side panel 22 having a length and a width defining two oppositely positioned longitudinal ends 24 and two oppositely positioned transverse ends 26 positioned perpendicular to the longitudinal ends 24. The intermediate side panel 22 is hingedly joined to an opposite transverse end 8 of the rectangular base panel 4 at an intermediate side panel fold line 28. The intermediate side panel fold line 28 extends between the intermediate side panel 22 and the rectangular base panel 4. The intermediate side panel 22 has a pair of dust panels 30. One dust panel is attached at each of the oppositely positioned transverse ends 24 of the intermediate side panel 22 at a dust panel fold line 32.

Outer member 2 has a rectangular top panel 34 having a length and a width defining two oppositely positioned longitudinal ends 36 and two oppositely positioned transverse ends 38 positioned perpendicular to the longitudinal ends 36. The rectangular top panel 34 is hingedly joined along one transverse end 38 of the rectangular top panel 34 to the intermediate side panel 22 at a second intermediate side panel fold line 40 opposite to the intermediate side panel fold line 28. Rectangular top panel 34 has a pair of outer end panels 42. One of the outer end panels 42 is hingedly joined to each of the longitudinal ends 36 of the rectangular top panel 34 at an outer end panel fold line 44 which extends a distance between said rectangular top panel 34 and its respective outer end panel 42. Outer member 2 further has an outer side panel 46, which is hingedly joined to the opposite transverse end 38 of the rectangular top panel 34 at an outer side panel fold line 48. The outer side panel fold line 48 extends a distance between said outer side panel 46 and the rectangular top panel 34.

Outer member 2 has a plurality of cavities 50. At least one cavity 50 is positioned through the inner side panel 10 at a position adjacent to the inner side panel fold line 12, and another cavity 50 being positioned through the intermediate side panel 22 at a position adjacent to the intermediate side panel fold line 52. Alternatively, at least one cavity 50 is positioned through each of the inner end panels 14 at a position adjacent to its respective inner end panel fold line 16 between the top panel 4 and the a respective first end panel 14. In one embodiment, the plurality of cavities 50 comprises a pair of cavities 50 which are positioned through the inner side panel 10 at a postion adjacent to the side panel fold line 12 and a pair of cavities 50 are positioned through the intermediate side panel 22 at a position adjacent to the intermediate side panel fold line 52.

In one embodiment of the invention, the inner side panel 10 comprises a plurality of minor panels 54 wherein the minor panels 54 are separated from one another by a notch 56. In another embodiment, box construction further comprises at least one viewing slot 58 through the rectangular base panel 4. This allows viewing product information or scanning of bar codes. In another embodiment base panel 4 further comprises an opening panel 60 which may be in the form of a series of perforations 62 optionally terminating at a finger hole 64.

Figure 2:
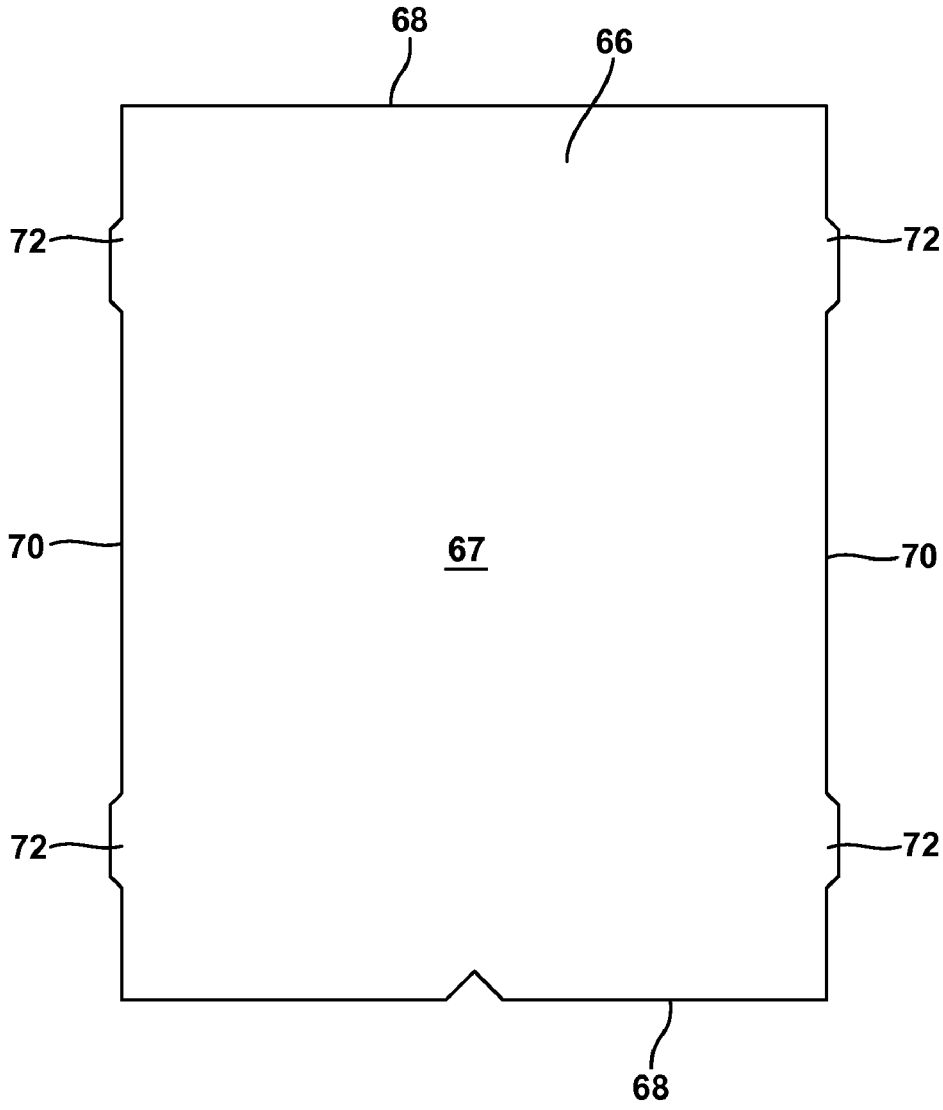
FIG. 2 shows an inner member portion of the box construction according to the invention.

FIG. 2 shows another portion of the box construction according to the invention. It shows an inner member 66 which comprises a planar, rectangular panel 67 having a length and a width defining two oppositely positioned longitudinal ends 68 and two oppositely positioned transverse ends 70. It has a plurality of stubs 72 extending outwardly from oppositely positioned ends of the planar, rectangular panel 67. The stubs 72 are within the plane of the planar, rectangular panel 67. The stubs 72 of the inner member 66 are arranged to be positioned within one of the cavities 50 of the outer member 2.

Figure 3:
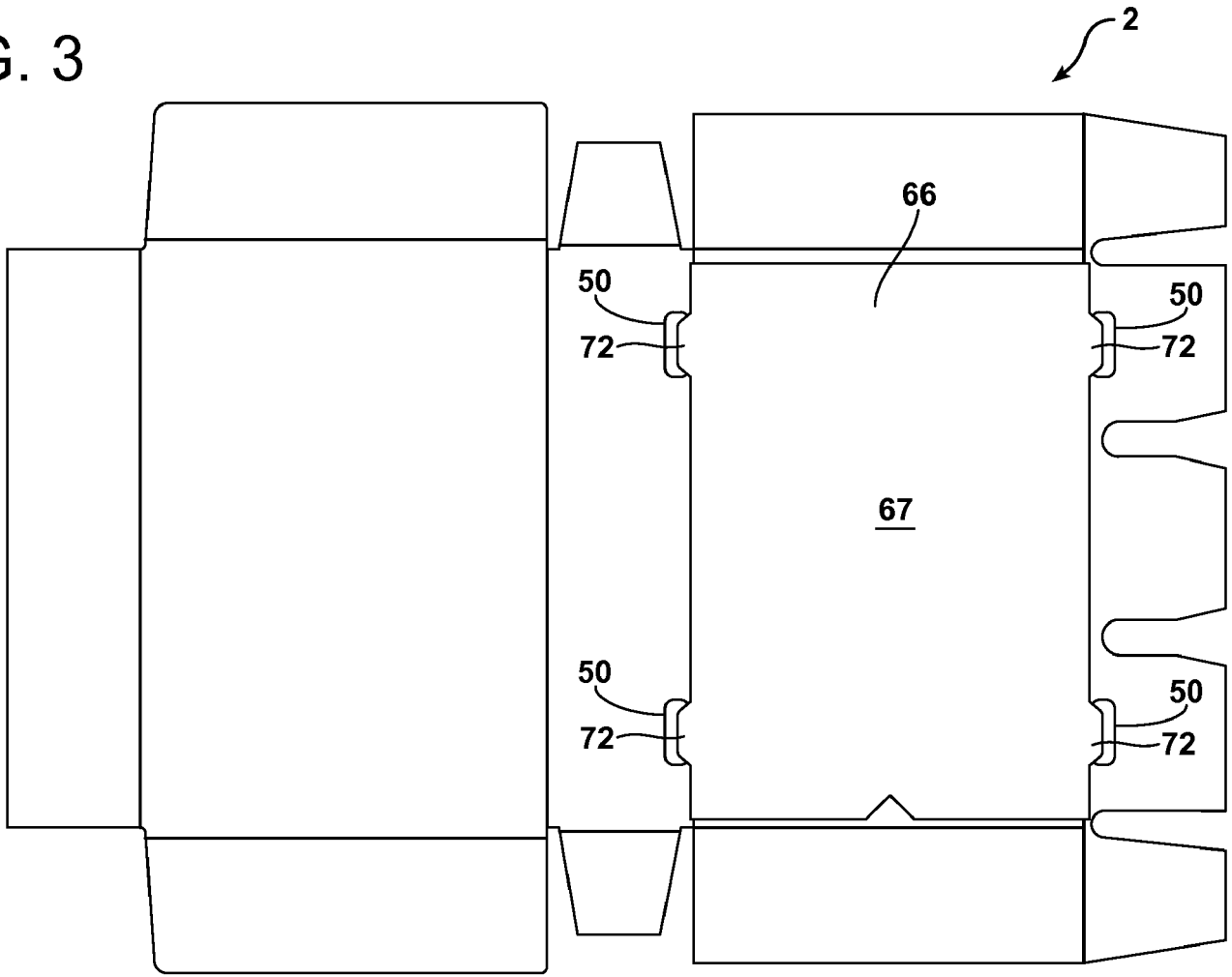
FIG. 3 shows a box construction according to the invention wherein inner member 66 is placed on outer member 2.

FIG. 3 shows the box construction according to the invention wherein inner member 66 is placed on outer member 2 such that the planar, rectangular panel 67 of the inner member is positioned on the rectangular base panel 4 of outer member 2, and each of the stubs 72 of the inner member are placed within cavities 50 of the outer member 2. Preferably, at least one of the inner member 66 and the outer member 2 comprises a flexible sheet material, such as cardboard or corrugated cardboard.

In use, the invention providers a method for enclosing any object that fits within the interior of the formed outer box construction, including objects such as one or more books, or recording media such as CD-ROMS, CD, or DVDs. A box construction is formed by providing an outer member 2 and an inner member 66 as described above.

Figure 4:
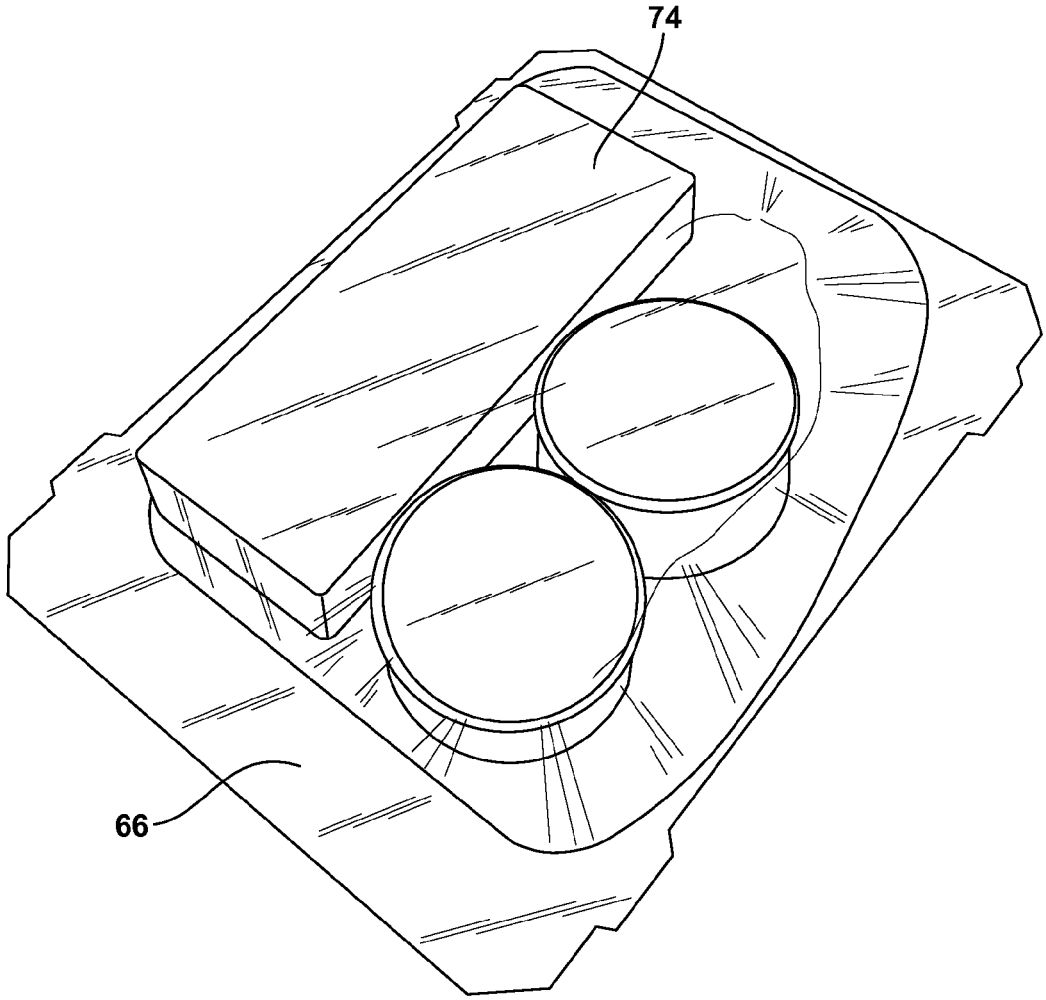
FIG. 4 shows several objects which to be packaged attached onto a surface of the inner member.

An object is then affixed onto a surface of the inner member 66. As seen in FIG. 4, several objects 74 to be packaged are affixed onto a surface of the inner member 66. Such affixing may be by any convenient means, such as via shrink wrapping a shrinkable plastic around the objects 74 and the inner member 66 as seen in FIG. 4. Other useful attaching methods include wrapping both with one or more elastic bands, tape or twine. Then the opposite surface of the inner member 66 is positioned on the rectangular base panel 4 of the outer member 2 such that each of the stubs 72 of the inner member 66 is positioned within one of the cavities 50 of the outer member 2. This is shown in FIG. 3 except without the objects 74.

One then folds the inner side panel 10, the inner end panels 14, the corner panels 18, the intermediate side panel 22, the dust panels 30, the rectangular top panel 34, the outer end panels 42, and outer side panel 46 on their respective fold lines in order to surround the object 74 on the inner member 66. One then attaches at least some of the inner side panel 10, the inner end panels 14; the dust panels 30, the outer end panels 42, and outer side panel 46 to its respective adjacent panel thus enclosing the object 74 within the box construction. Attaching may be via any known means such as via an adhesive, wrapping, taping, and the like. It is not necessary that each of the panels be attached to its adjacent panel. For example, corner panels 18 may be held in position by pressure from an inner side panel 10 and outer side panel 46 after the folding and attaching steps IV and V.

One method of opening the box construction in order to remove the objects 74 would be to tear open panel 60 by inserting a finger into finger hole 64, and then tearing the outer member along series of perforations 62, and then manually removing objects 74.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A box construction comprising:

A) an outer member which comprises:

(i) a rectangular base panel having a length and a width defining two oppositely positioned longitudinal ends and two oppositely positioned transverse ends perpendicular to the longitudinal ends; an inner side panel, the inner side panel being hingedly joined to one of said transverse ends of the rectangular base panel at an inner side panel fold line, which inner side panel fold line extends between the inner side panel and the rectangular base panel; a pair of inner end panels, one of said inner end panels being hingedly joined to each of the longitudinal ends of the rectangular base panel at a first end panel fold line which extends between said base panel and a respective first end panel; each of the inner end panels having a corner panel extending outwardly from a side of one of said inner end panels and being attached to a respective first end panel at a corner panel fold line which corner panel fold line is adjacent to and positioned perpendicular to a respective first end panel fold line;

ii) an intermediate side panel having a length and a width defining two oppositely positioned longitudinal ends and two oppositely positioned transverse ends perpendicular to the longitudinal ends, the intermediate side panel being hingedly joined to an opposite transverse end of the rectangular base panel at an intermediate side panel fold line, which intermediate side panel fold line extends between said intermediate side panel and the rectangular base panel; a pair of dust panels, one dust panel attached at each of the oppositely positioned transverse ends of the intermediate side panel at a dust panel fold line;

iii) a rectangular top panel having a length and a width defining two oppositely positioned longitudinal ends and two oppositely positioned transverse ends perpendicular to the longitudinal ends; the rectangular top panel being hingedly joined along one transverse end of the rectangular top panel to the intermediate side panel at a second intermediate side panel fold line opposite to the intermediate side panel fold line; a pair of outer end panels, one of said outer end panels being hingedly joined to each of the longitudinal ends of the rectangular top panel at an outer end panel fold line which extends a distance between said rectangular top panel and a respective outer end panel; an outer side panel, the outer side panel being hingedly joined to the opposite transverse end of the rectangular top panel at an outer side panel fold line which outer side panel fold line extends a distance between said outer side panel and the rectangular top panel; and iv.) a plurality of cavities, at least one cavity being positioned through the inner side panel at a position adjacent to the inner side panel fold line and another cavity being positioned through the intermediate side panel at a position adjacent to the intermediate side panel fold line; or at least one cavity being positioned through each of the inner end panels at a position adjacent to a respective inner end panel fold line between the base panel and the respective inner end panel; and B) an inner member which comprises a planar, rectangular panel having a length and a width defining two oppositely positioned longitudinal ends and two oppositely positioned transverse ends; a plurality of stubs extending outwardly from oppositely positioned ends of the planar, rectangular panel and said stubs being within the plane of the planar, rectangular panel;

each of the stubs of the inner member being positioned within one of the cavities of the outer member.

2. The box construction according to claim 1 further comprising at least one viewing slot through the rectangular base panel.

3. The box construction according to claim 1 wherein at least one of the inner member and the outer member comprises a flexible sheet material.

4. The box construction according to claim 1 wherein at least one of the inner member and the outer member comprises cardboard or corrugated cardboard.

5. A method for enclosing an object which comprises the steps of:

I) providing a box construction which comprises an outer member and an inner member, A) the outer member comprises:

(i) a rectangular base panel having a length and a width defining two oppositely positioned longitudinal ends and two oppositely positioned transverse ends perpendicular to the longitudinal ends; an inner side panel, the inner side panel being hingedly joined to one of said transverse ends of the rectangular base panel at an inner side panel fold line, which inner side panel fold line extends between the inner side panel and the rectangular base panel; a pair of inner end panels, one of said inner end panels being hingedly joined to each of the longitudinal ends of the rectangular base panel at a first end panel fold line which extends between said base panel and a respective first end panel; each of the inner end panels having a corner panel extending outwardly from a side of one of said inner end panels and being attached to a respective inner end panel at a corner panel fold line which corner panel fold line is adjacent to and positioned perpendicular to a respective inner end panel fold line;

ii) an intermediate side panel having a length and a width defining two oppositely positioned longitudinal ends and two oppositely positioned transverse ends perpendicular to the longitudinal ends, the intermediate side panel being hingedly joined to an opposite transverse end of the rectangular base panel at an intermediate side panel fold line, which intermediate side panel fold line extends between said intermediate side panel and the rectangular base panel; a pair of dust panels, one dust panel attached at each of the oppositely positioned transverse ends of the intermediate side panel at a dust panel fold line; and iii) a rectangular top panel having a length and a width defining two oppositely positioned longitudinal ends and two oppositely positioned transverse ends perpendicular to the longitudinal ends; the rectangular top panel being hingedly joined along one transverse end of the rectangular top panel to the intermediate side panel at a second intermediate side panel fold line opposite to the intermediate side panel fold line; a pair of outer end panels, one of said outer end panels being hingedly joined to each of the longitudinal ends of the rectangular top panel at an outer end panel fold line which extends a distance between said rectangular top panel and a respective outer end panel; an outer side panel, the outer side panel being hingedly joined to the opposite transverse end of the rectangular top panel at an outer side panel fold line which outer side panel fold line extends a distance between said outer side panel and the rectangular top panel;

iv.) a plurality of cavities, at least one cavity being positioned through the inner side panel at a position adjacent to the inner side panel fold line and another cavity being positioned through the intermediate side panel at a position adjacent to the intermediate side panel fold line; or at least one cavity being positioned through each of the inner end panels at a position adjacent to a respective inner end panel fold line between the base panel and the respective inner end panel;

B) an inner member which comprises a planar, rectangular panel having a length and a width defining two oppositely positioned longitudinal ends and two oppositely positioned transverse ends; a plurality of stubs extending outwardly from oppositely positioned ends of the planar, rectangular panel and said stubs being within the plane of the planar, rectangular panel; each of the stubs of the inner member being positioned within one of the cavities of the outer member; and conducting II), III, IV), and V) in any order:

II) attaching an object onto a surface of the inner member;

III) positioning an opposite surface of the inner member on the rectangular base panel such that each of the stubs of the inner member is positioned within one of the cavities of the outer member;

IV) folding the inner side panel, the inner end panels, the corner panels, the intermediate side panel, the dust panels, the rectangular top panel, the outer end panels, and outer side panel around an object on the inner member; and V) attaching at least some of the inner side panel, the inner end panels, the corner panels, the outer end panels, and outer side panel to a respective adjacent panel thus enclosing an object within the box construction.

6. The method according to claim 5 wherein the inner side panel comprises a plurality of minor panels, said minor panels being separated from one another by a notch.

7. The method according to claim 5 wherein the plurality of cavities comprises a pair of cavities positioned through the inner side panel at a position adjacent to the inner side panel fold line and a pair of cavities positioned through the intermediate side panel at a position adjacent to the intermediate side panel fold line.

8. The method according to claim 5 wherein the box construction further comprises at least one viewing slot through the base panel.

9. The method according to claim 5 wherein at least one of the inner member and the outer member comprises a flexible sheet material.

10. The method according to claim 5 wherein at least one of the inner member and the outer member comprises cardboard or corrugated cardboard.

11. The method according to claim 5 wherein at least one of the base panel or the top panel further comprises an opening panel.

12. The method according to claim 5 wherein the opening panel comprises at least one series of perforations terminating at a finger hole.

13. The method according to claim 5 wherein the object comprises at least one book or recording medium.

14. The method according to claim 5 wherein the steps are conducted in the order I, and then II, and then III, and then IV, and then V.

* * * * *